United States Patent [19]

Lai

[11] Patent Number: 5,016,611

[45] Date of Patent: May 21, 1991

[54] CAMPING LANTERN AND COOKING STOVE SET

[76] Inventor: Kou Y. Lai, No. 32, Alley 27, Lane 127, Nan Shan Rd., Chung Ho City, Taipei Hsien, Taiwan

[21] Appl. No.: 512,404

[22] Filed: Apr. 23, 1990

[51] Int. Cl.[5] ..... F24C 5/04; F21H 1/00

[52] U.S. Cl. ..... 126/258; 126/255; 126/52; 362/159; 362/190

[58] Field of Search ..... 126/258, 255, 260, 256, 126/52, 38; 362/157, 159, 160, 312, 163, 190

[56] References Cited

U.S. PATENT DOCUMENTS 615,658 12/1898 Wilson ..... 362/312

3,154,065 10/1964 Bencoe ..... 126/260 X 4,149,225 4/1979 Barson ..... 362/160 X 4,445,495 5/1984 Frost ..... 126/24

4,653,462 3/1987 DeFoe ..... 126/24

4,791,538 12/1988 Prest ..... 126/39 R X

*Primary Examiner*—Larry Jones

*Attorney, Agent, or Firm*—Staas & Halsey

[57] ABSTRACT

A camping lantern and cooking stove set for use with a gas canister includes a valve, which is attachable to the gas canister for regulating an outflow of gas to either a mixing tube designed to distribute an appropriate amount of gas to a gas lantern or a mixing tube designed to distribute an appropriate amount of gas to a cooking stove.

3 Claims, 4 Drawing Sheets

CAMPING LANTERN AND COOKING STOVE SET

BACKGROUND OF THE INVENTION

This invention relates to a valve for a gas canister, and, more particularly, to a valve for a gas canister which is adaptable to both a camping lantern and cooking stove.

Conventional gas canisters used for different functions, most commonly as a fuel supply for a cooking stove and a lantern, must be supplied with a different valve to suit one of either function. Unfortunately, valves are quite expensive and bulky. A cooking burner and lantern which could be packaged together with the same valve adaptable to either use would be most convenient and economical for the camper.

SUMMARY OF THE INVENTION

Accordingly, a primary objective of the present invention is to provide a valve for a gas canister which is adaptable to both a lantern and a cooking stove.

Another objective of the present invention is to provide a valve for a gas canister to which is fittable a first mixing tube suitable for use in conjunction with a gas lantern, or alternatively, a second mixing tube suitable for use in conjunction with a cooking stove.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
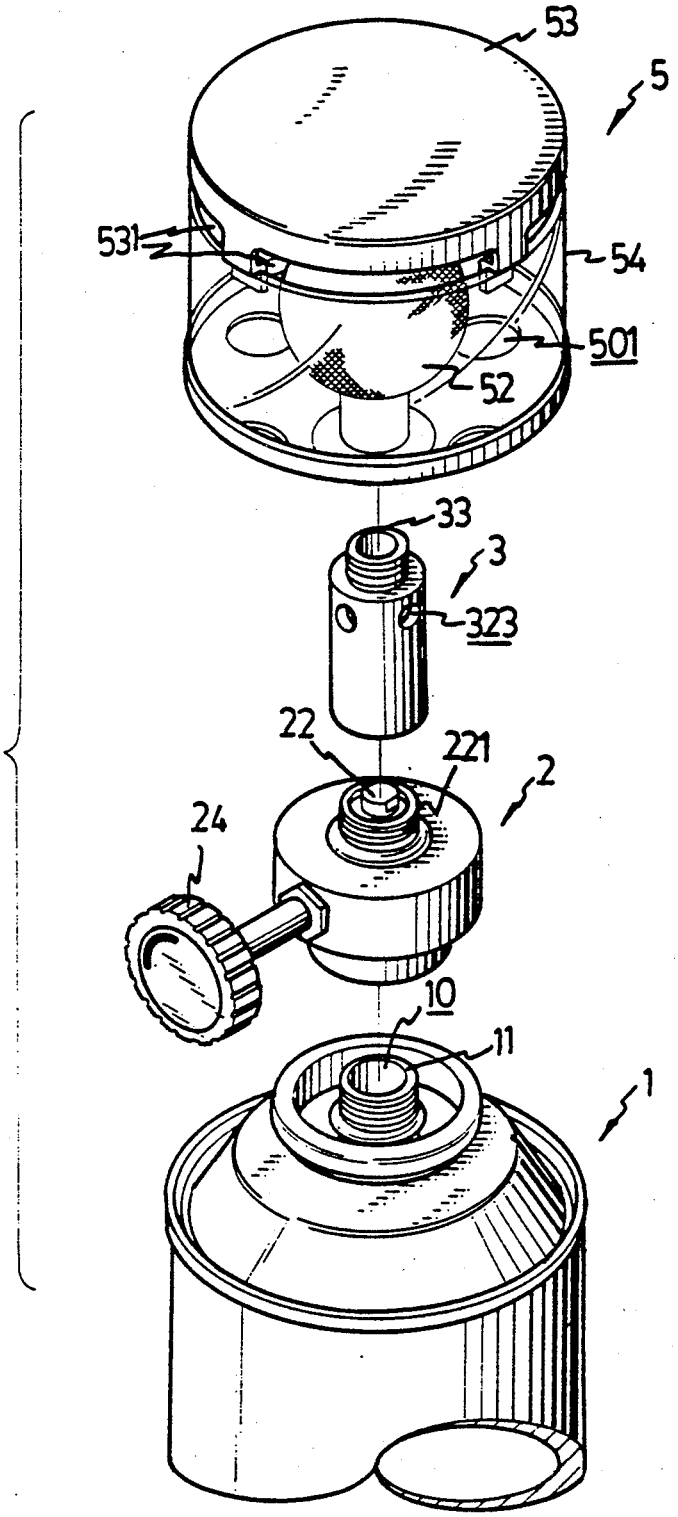
FIG. 1 is an exploded perspective view of a gas canister with attached lantern in accordance with the present invention.

With reference to the drawings initially to FIG. 1, it can be seen that an adjustable gas canister in accordance with the present invention comprises a canister 1, a valve 2 and a mixing tube 3.

Figure 2:
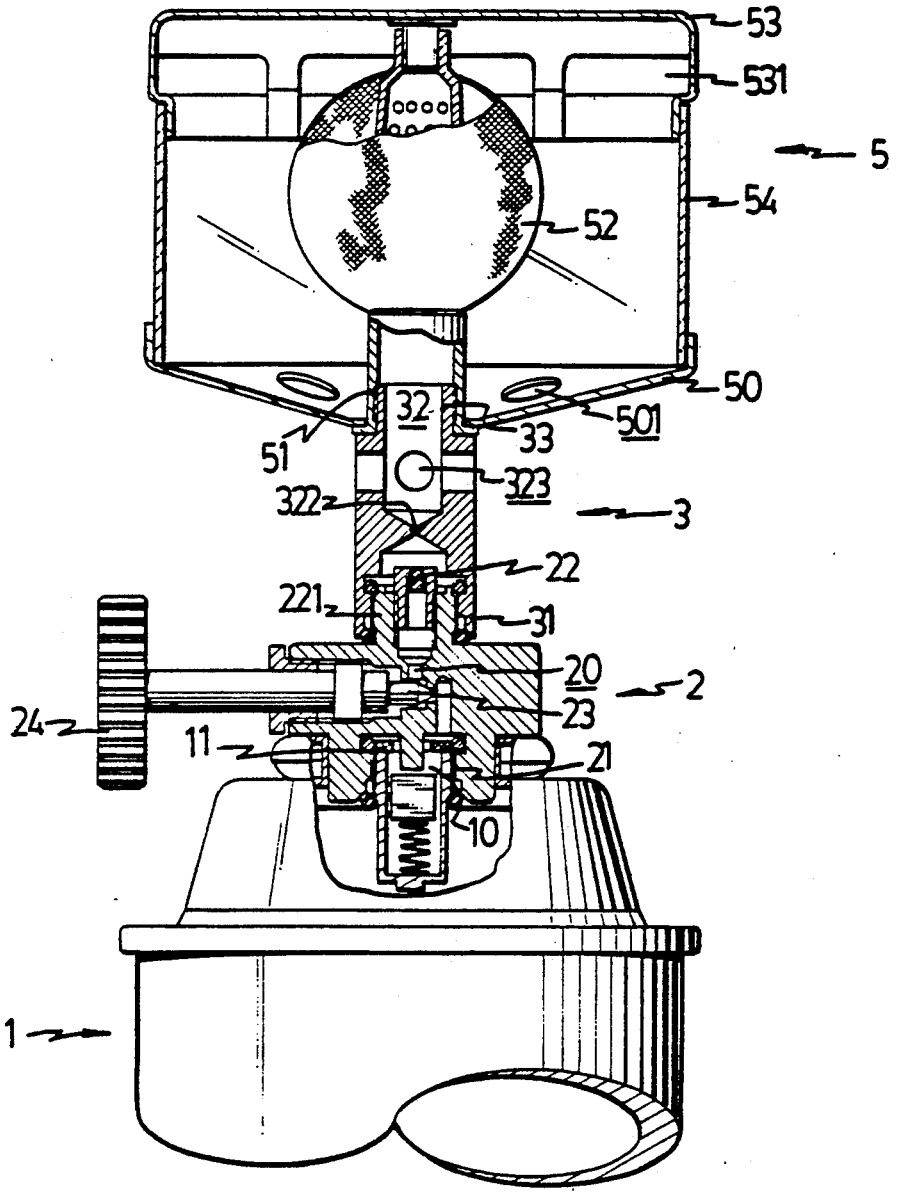
FIG. 2 is a sectional side view of FIG. 1.

The canister 1 is formed on an upper side thereof with an outlet 10 formed within a flange 11 provided around an outer perimeter thereof with threading. The valve 2 is provided with a socket 21 on a lower end thereof for receiving the flange 11 and twistably securing thereto. The valve 2 is essentially a cylinder formed with a through passage 20. As shown in FIG. 2, an outflow of gas from the canister 1 through the passage 20 is regulatable by means of a stem 23 disposed within through passage 20. The stem 23 is formed on an end of an adjusting knob 24. The adjusting knob 24 can be twisted by a user to adjust the position of the stem 23 within the through passage 20, i.e. to allow the outflow of gas by unblocking the through passage 20 or to prohibit the outflow of gas by blocking the through passage 20 with the stem 23. An upper portion of the valve 2 is formed with a nozzle 22 for directing the outflow of gas therefrom. The nozzle 22 is settled within a flange 221 provided around an outer perimeter thereof with threading.

The mixing tube 3 is provided on a lower end thereof with a socket 31 for receiving and twistably securing to the flange 221. The mixing tube 3 is essentially a hollow cylinder provided with a central gas through passage 32. In one preferred embodiment, as shown in FIGS. 1 and 2, the mixing tube is particularly adapted for a camping lantern in that the central gas through passage 32 is shaped to provide only a pin hole passage 322 to form an hourglass-like section through which the gas is passable. A diameter of the pin hole passage 322 is smaller than a diameter of the nozzle 22 for directing and regulating an amount of gas appropriate for illumination. A plurality of breath holes 323 are provided in the mixing tube 3 for aerating a flame. Each breadth hole communicates with the central gas through passage at a point above the hourglass-like section, for providing oxygen to a flame of the gas lantern. An upper portion of the mixing tube 3 is formed with a flange 33 provided on an outer perimeter thereof with threading.

A lantern 5 is therefore provided on a base 50 thereof with a socket 51 for receiving and twistably securing to the mixing tube 3. A disposable ceramic net mantle 52 of the kind ordinarily sold in camping supply shops for use with camping lanterns is placed by a user within the lantern 5 for allowing the lantern 5 to project an illumination of approximately a 40 watt light bulb. A transparent heat resistant screen 54 fits on the base 50 with breath holes 501 under a cover 53, also provided with breath holes 531, around the ceramic net mantle 52 for protection.

Figure 3:
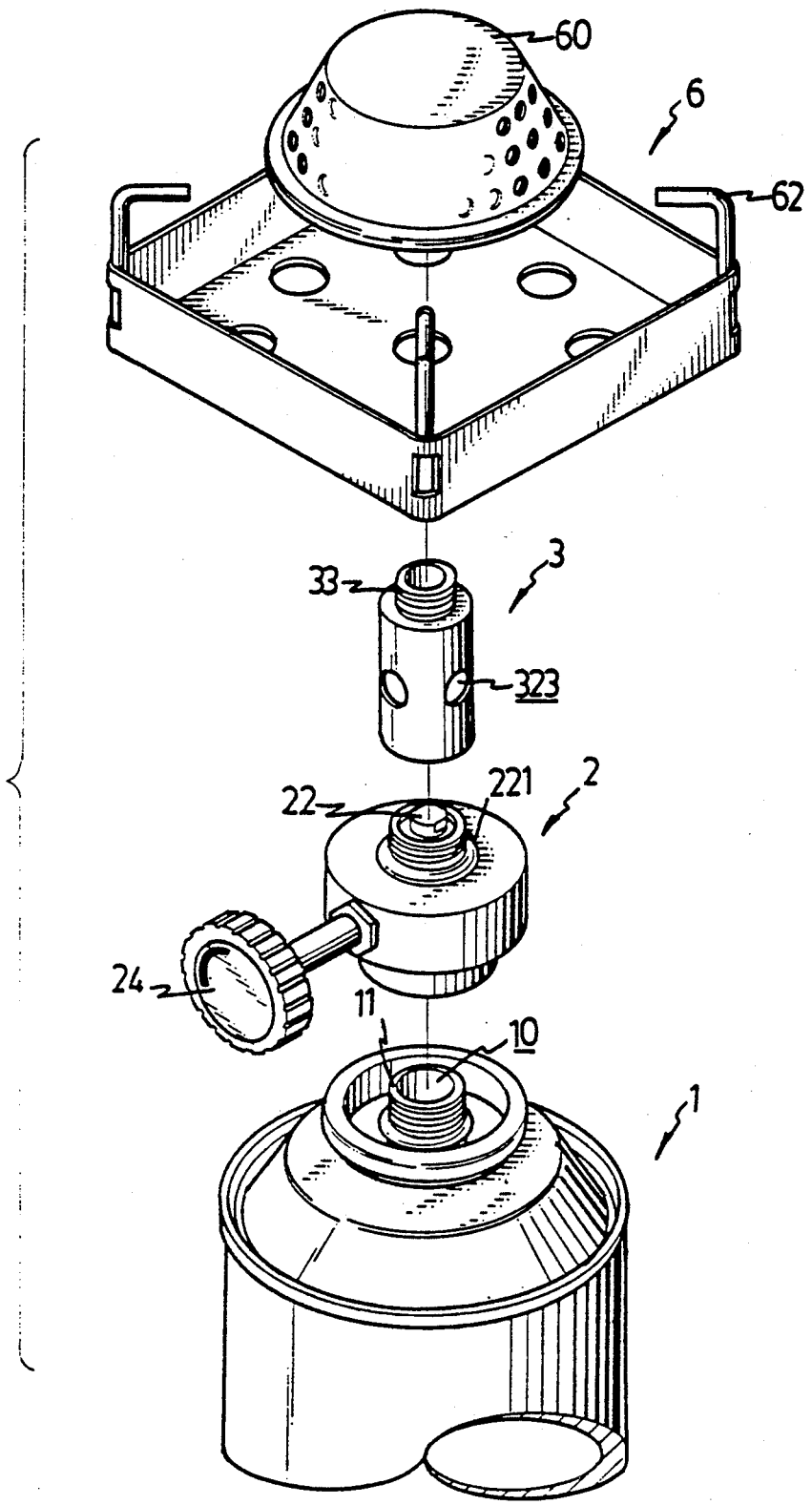
FIG. 3 is an exploded perspective view of a gas canister with attached cooking stove in accordance with the present invention; and, FIG. 4 is a sectional side view of FIG. 3.
Figure 4:
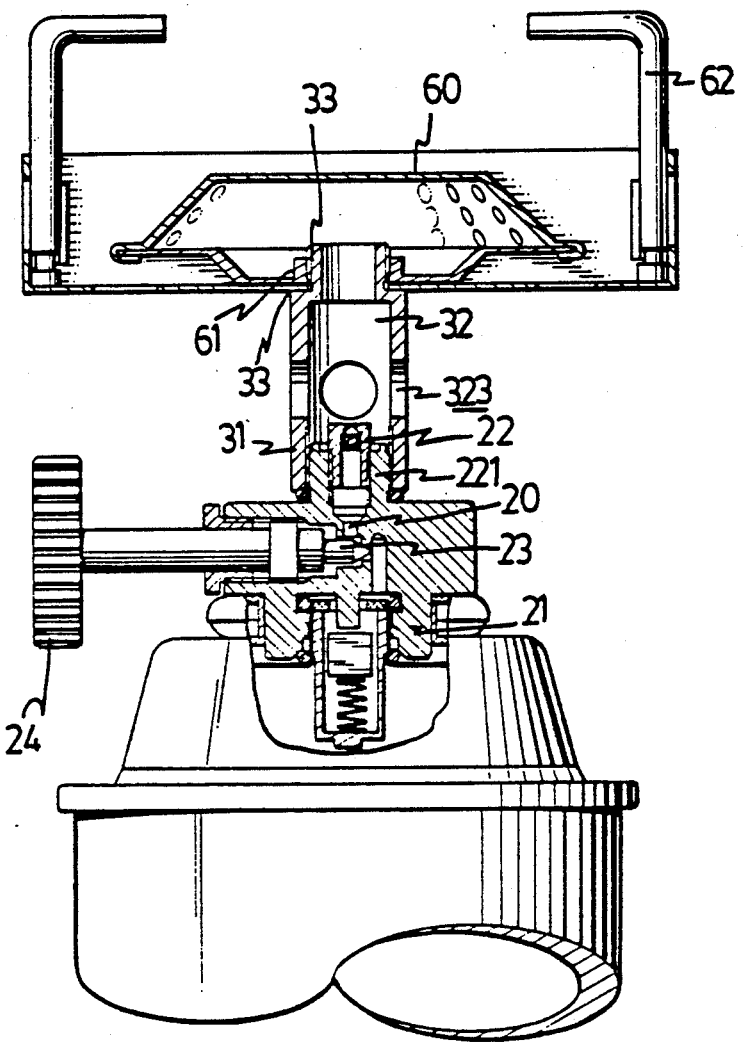

In another preferred embodiment, as shown in FIGS. 3 and 4, the mixing tube 3 is particularly adapted to a cooking stove in that the through passage 32 is wide enough to allow sufficient an outflow of gas for cooking purposes. The through passage 32 is provided with a plurality of breath holes 323 for aerating the flame. Each breadth hole communicates with the central gas through passage at a point above the hourglass-like section, for providing oxygen to a flame of the gas lantern. The mixing tube 3 is further provided on an upper portion thereof with a flange 33 provided on an outer perimeter thereof with threading.

A cooking stove 6 is therefore provided on a base to thereof with a socket 61 for receiving and twistably securing to the mixing tube 3. Within the cooking. stove is disposed a burner 60. A grill 62, on which food can be cooked, is provided over the burner 60.

A gas canister 1 fitted with the valve 2 and appropriate mixing tube 3 can then be used to fuel either a lantern 5 or a cooking stove 6 allowing the camper convenience and flexibility.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A camping lantern and cooking stove set, for use with a gas canister, formed on an upper end thereof with an outlet disposed within a first flange, comprising a valve formed on a lower end thereof with a socket for receiving said first flange and provided with a through passage with a nozzle for allowing an outflow of gas from said canister, an outlet for gas through said through passage regulatable by means of a stem disposed within said through passage, said stem being formed at an end of an adjustable knob for adjusting the blockade of said through passage; the improvement comprising:

a mixing tube attachable to said valve for further regulating or mixing the outflow of gas from said canister, a socket being formed on a lower end of said mixing tube for receiving and securably attaching to said valve, a second flange being formed on an upper end of said mixing tube for selective connection with either a camping lantern or a cooking stove, said mixing tube having a central gas through passage, said central gas through passage having a pin hole passage to form an hourglass-like section at a lower portion thereof, a plurality of breadth holes being formed on an outer periphery of said mixing tube, each said breadth hole communicating with said central gas through passage at a point above said hourglass-like section, for providing oxygen to a flame of either said camping lantern or said cooking stove.

2. A camping lantern and cooking stove set comprising:

a valve having a socket on one end thereof for attachment to a gas canister sealingly over an outlet of the gas canister, said valve having a through passage and a nozzle for outflow of gas from said gas canister;

flow control means disposed in the through passage for controlling outflow of gas from the gas canister;

a first mixing tube having one end attachable to said nozzle of said valve and having an axial gas passage and radial air passages communicating with the axial gas passage for mixing gas from the canister with air for a lantern attachment attachable to an opposite end of the first mixing tube; and a second mixing tube having one end attachable to said nozzle of said valve and having an axial gas passage and radial air passages communicating with the axial gas passage for mixing gas from the canister with air for a cooking stove attachment attachable to an opposite end of the second mixing tube.

3. A camping lantern and cooking stove set according to claim 2, wherein the axial gas passage and radial air passages of the first mixing tube have a diameter smaller than the axial gas passage and the radial air passages of the second mixing tube.

* * * * *